US008534714B2

(12) United States Patent
Buchanan et al.

(10) Patent No.: US 8,534,714 B2
(45) Date of Patent: Sep. 17, 2013

(54) COUPLING DEVICE FOR CONNECTION AND DISCONNECTION OF BOTTOM-HOLE EQUIPMENT

(75) Inventors: Alastair Buchanan, Stavanger (NO); Kjell Tore Nesvik, Kverneland (NO); Vibjørn Dagestad, Hafrsfjord (NO)

(73) Assignee: Statoilhydro ASA, Stavanger (NO)

( * ) Notice: Subject to any disclaimer, the term of this patent is extended or adjusted under 35 U.S.C. 154(b) by 798 days.

(21) Appl. No.: 12/373,269

(22) PCT Filed: Jul. 4, 2007

(86) PCT No.: PCT/NO2007/000258
§ 371 (c)(1),
(2), (4) Date: May 1, 2009

(87) PCT Pub. No.: WO2008/007970
PCT Pub. Date: Jan. 17, 2008

(65) Prior Publication Data

US 2009/0280912 A1 Nov. 12, 2009

(30) Foreign Application Priority Data

Jul. 10, 2006 (NO) ..... 20063203

(51) Int. Cl.
*F16L 39/00* (2006.01)
*F16L 37/091* (2006.01)

(52) U.S. Cl.
USPC ..... 285/317; 285/34

(58) Field of Classification Search
USPC ..... 403/109.3, 328; 285/922, 34, 317, 285/85, 86, 90, 91, 316; 166/377, 380, 242.2, 166/242.6, 242.7
See application file for complete search history.

(56) References Cited

U.S. PATENT DOCUMENTS

| | | | | |
|---|---|---|---|---|
| 2,644,524 | A * | 7/1953 | Baker | 285/34 |
| 3,071,188 | A * | 1/1963 | Raulins | 285/23 |
| 4,883,121 | A | 11/1989 | Zwart | |
| 5,518,072 | A | 5/1996 | McTernaghan | |
| 5,787,982 | A | 8/1998 | Bakke | |
| 5,829,480 | A * | 11/1998 | Smith, III | 137/614.04 |
| 6,209,652 | B1 | 4/2001 | Portman et al. | |
| 6,213,206 | B1 * | 4/2001 | Bakke | 166/242.7 |
| 6,250,393 | B1 | 6/2001 | Mackenzie et al. | |
| 6,425,443 | B1 * | 7/2002 | Hill et al. | 166/377 |
| 6,439,305 | B1 | 8/2002 | Bakke | |

(Continued)

FOREIGN PATENT DOCUMENTS

EP 0 298 683 A2 1/1989

*Primary Examiner* — Daniel P. Stodola
*Assistant Examiner* — James Linford
(74) *Attorney, Agent, or Firm* — Birch, Stewart, Kolasch & Birch, LLP

(57) ABSTRACT

A coupling device for connection and disconnection of bottomhole equipment includes a male part having a stinger with locking grooves and a female part includes a receptacle and a housing. The female part further includes a hold open sleeve below the receptacle, locking dogs arrange between the housing and the hold open sleeve, a locking sleeve arranged below the locking dogs, and a verifying bolt. By joining the male and female parts, the coupling device will lock automatically, as the hold open sleeve is pushed into the locking sleeve by the stinger, after which the locking dogs are pushed into the grooves of the stinger, after which the locking sleeve is pushed up over the locking dogs locking the locking dogs, after which the verifying bolt once the locking sleeve is in locking position will be pushed into an adapted opening in the locking sleeve, thereby verifying correct locking.

10 Claims, 7 Drawing Sheets

(56) References Cited

Figure 1:
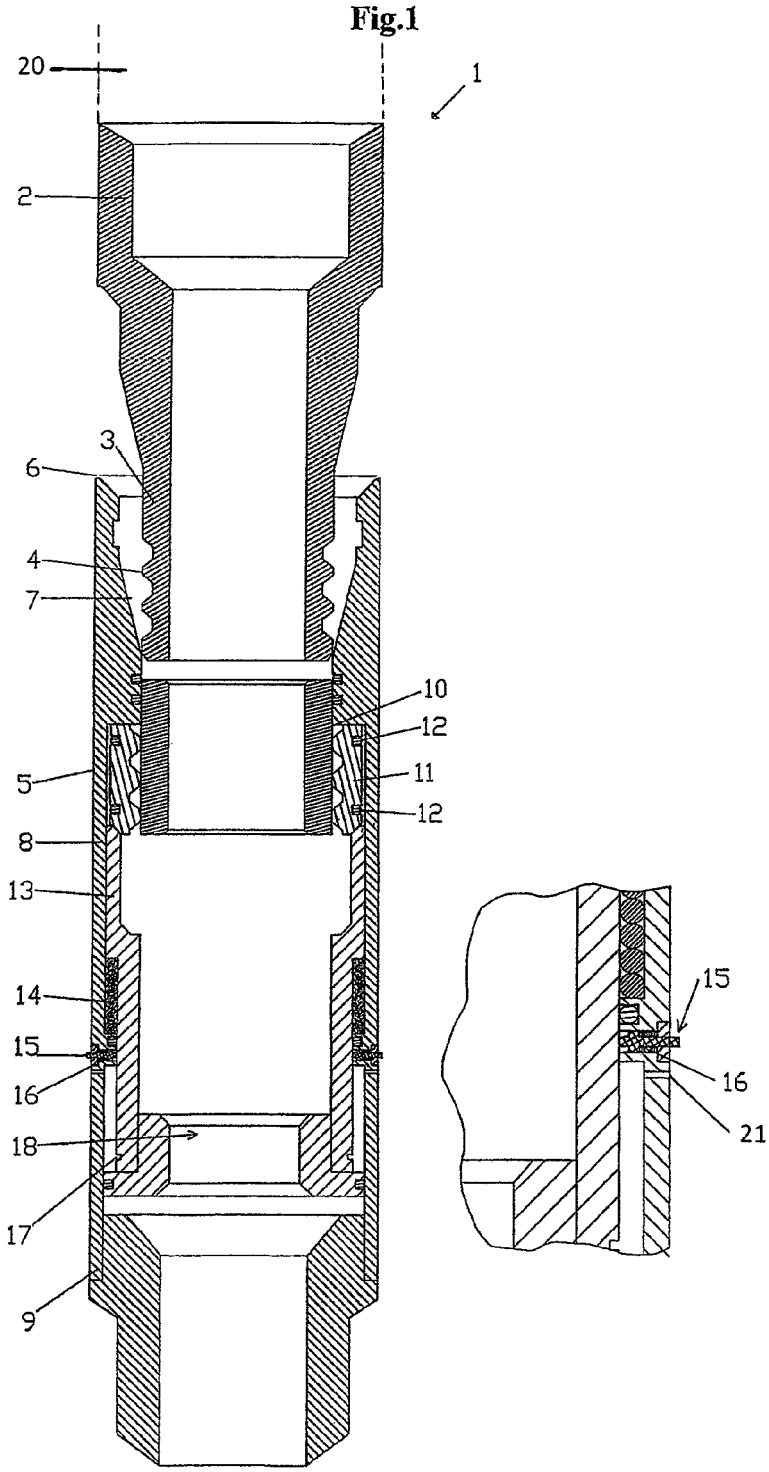

U.S. PATENT DOCUMENTS 6,450,541 B1 9/2002 Bakke
6,460,900 B1 10/2002 Bakke
6,698,514 B2 3/2004 Norris et al.
2007/0231064 A1* 10/2007 Carnevali ..... 403/328

* cited by examiner

COUPLING DEVICE FOR CONNECTION AND DISCONNECTION OF BOTTOM-HOLE EQUIPMENT

FIELD OF THE INVENTION

The present invention relates to a coupling device for connection and disconnection of bottom-hole equipment, which coupling device comprises a male part that is arranged at the end of a coiled tubing, and a female part. More specifically, the invention relates to a coupling device that locks automatically by joining the male and female parts, the coupling device comprising a device to verify correct locking.

BACKGROUND OF THE INVENTION AND PRIOR ART

Several coupling devices for coiled tubing are known. The coupling devices generally comprise a male and a female part, of which the male part can be fastened at the end of a coiled tubing and the female part can be arranged as a part of a bottom-hole equipment that can be brought down with the coiled tubing.

When joining the coupling parts on deck it will, because of high stiffness of the coiled tubing, be difficult to position the coiled tubing correctly, for which reason the coupling parts are designed for simple alignment into position for joining. The units can also be joined within a well bore, as one coupling part is brought down into the well on the end of a coiled tubing for joining with the other coupling part that previously has been arranged in the well bore.

Examples of coupling devices of the above-mentioned types are described in the U.S. Pat. Nos. 6,460,900, 6,450,541, 5,787,982, 6,209,652, 6,439,305 and 6,698,514, to which publications reference is made.

None of the above-mentioned patent applications describes a coupling device comprising a verifying device that can verify whether the coupling and locking are correct. Neither are any coupling devices described that locks automatically by joining of the coupling parts, whereby connection and disconnection take place at the same position in the working string, without any further manipulation than joining the coupling parts. There is a demand for a coupling device for coiled tubing, which coupling device locks automatically when joining the coupling parts. There is also a demand for a coupling device with a verifying device that immediately after joining can verify correct locking.

In patent publication EP 0298683 B1 a down-hole lock assembly with a verifying device that can verify whether the coupling is correct or not, is described. However, the verification cannot be made until after one of the coupling parts, the so-called running tool (11) has been disconnected from the lower coupling part (12), the lock mandrel body. Said coupling device is relatively complicated and will not be locked automatically by simple joining of the coupling parts.

More specifically, patent publication EP 0298683 B1 describes a down-hole lock assembly comprising a lock mandrel (10) connected to a running tool (11) which holds an inner mandrel (13) located within a body (12) of the lock mandrel (10) in a position which allows lock-out keys (20) of the lock mandrel (10) to remain within the outside diameter of the lock mandrel body (12), shear pins (34) adapted on downward jarring against a landing nipple to expand the keys (20) and shear pins (33) adapted on upward jarring to release the running tool (11), said running tool (11) having a tell-tale device (30) to indicate that the lock mandrel (10) is correctly set in the landing nipple, the inner mandrel (13) being resiliently urged in an upward direction, i.e. in the direction of the flow from the well, to activate the lock-out keys (20) to set the lock, and latch means (22) being provided to hold the inner mandrel (13) in a downward disposition against its resilient means prior to setting the lock, distinguished in that the running tool (11) carries a tell-tale collet means (30) connected thereto by a shear pin (32), said collet means being adapted when the running tool (11) is released from the lock mandrel after setting the lock to disengage intact from the lock mandrel (10) if the lock-out keys (20) are correctly set and to foul the inner mandrel (13) and shear the shear pin (32) if the lock-out keys (20) are incorrectly set, said collet means being adapted to remain on said running tool (11) and be withdrawn with said running tool (11) when said running tool (11) is released from said mandrel (10) when said lock-out keys (20) are correctly set and also when said lock-out keys (20) are incorrectly set. The latch means (22) comprises longitudinally extending finger means (22) on the external face of the inner mandrel, biased laterally inwards but for location in the groove means (24, 25) in the inner face of the main body (12) at correct alignment for locking. Also the collet means on the running tool comprises a plurality of longitudinally extending fingers adapted to pass upwardly through the inner mandrel undamaged if the finger means of the latch are located in the upper groove of the main body and to strike said finger means if said finger means are not so located out of the path of the collet means, which means if the locking is not successful.

There is a demand for a simpler coupling device without the above-mentioned deficiencies.

SUMMARY OF THE INVENTION

With the present invention the above-mentioned demands are met, by providing a coupling device for connection and disconnection of bottom-hole equipment, comprising: a male part having a conically shaped stinger with locking grooves, which male part is arranged at the end of a coiled tubing; and a female part comprising a receptacle in an upper end and a house that constitutes the outer part of the female part from the receptacle to a lower end, which receptacle has conical shape adapted to receive the stinger of the male part. The coupling device is distinguished by the female part further comprising:

A hold-open sleeve within the house towards the upper end, adjacent and below the receptacle, which hold-open sleeve is axially displaceable in the house in direction towards the lower end and has an internal diameter smaller than the receptacle, locking dogs with a biasing device pushing the locking dogs radially inwards, which locking dogs are arranged between the house and the hold-open sleeve, a locking sleeve with a biasing device pushing the locking sleeve towards the upper end, which locking sleeve is arranged axially displaceable in the house below the locking dogs, with internal diameter towards the upper end large enough to receive the hold-open sleeve and an outer diameter smaller than or equal to the locking dogs in extended position, a verifying bolt with a biasing device pushing the verifying bolt radially inwards, which verifying bolt before joining the male and female parts has an outer end extending out of the house, such that by joining the male and female parts the coupling device will lock automatically, as the hold-open sleeve is pushed into the locking sleeve by the stinger, after which the locking dogs are pushed into the grooves of the stinger, after which the locking sleeve is pushed up over the locking dogs locking said locking dogs, after which the verifying bolt at once the locking sleeve is in locking position will be pushed into an adapted opening in the locking sleeve, thereby verifying correct locking.

The biasing devices are preferably in the form of springs. The coupling device preferably comprises several verifying bolts with spring pre-tensioning. Springs are preferred because of long working distance, reliability and good availability.

The locking sleeve preferably comprises a seat for receival of a ball that can be brought down the coiled tubing, such that the coupling device can be opened by applying a pressure through the coiled tubing when the ball is placed sealingly in the seat. Thereby a simple procedure for disconnection is provided, which can be worked from the surface. Alternatively, the female part comprises a feed-through in the house, which feed-through can be opened for applying fluid under pressure to open the coupling device.

The locking grooves and locking dogs preferably have axial surfaces of angle lower than 90° against the longitudinal axis of the coupling device, thereby the mate and female parts easily can be disconnected by axial tensioning when the locking sleeve is in the lower position.

FIGURES

Figure 2:
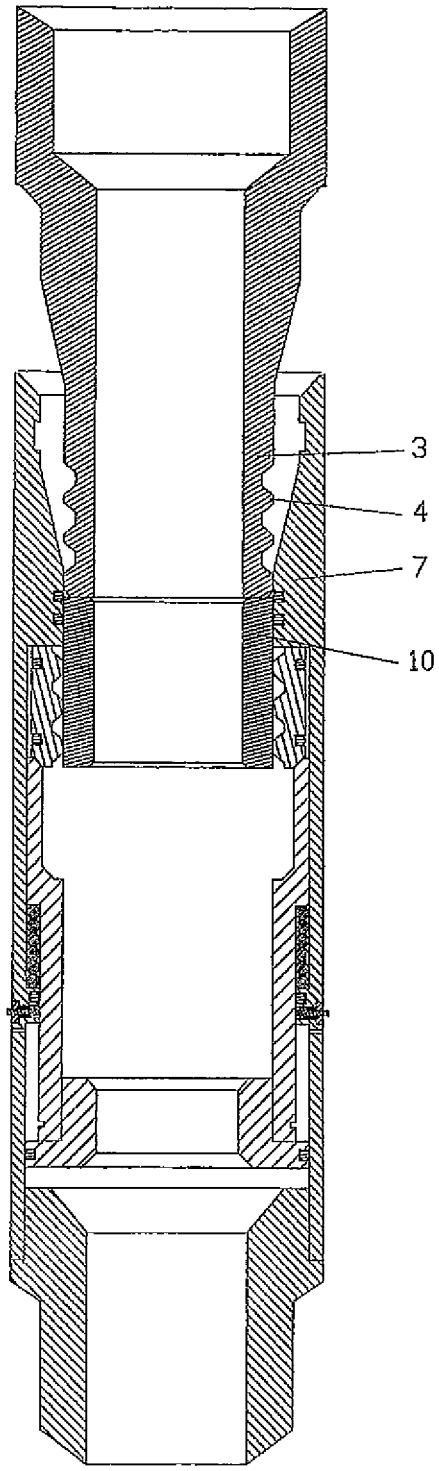
Figure 3:
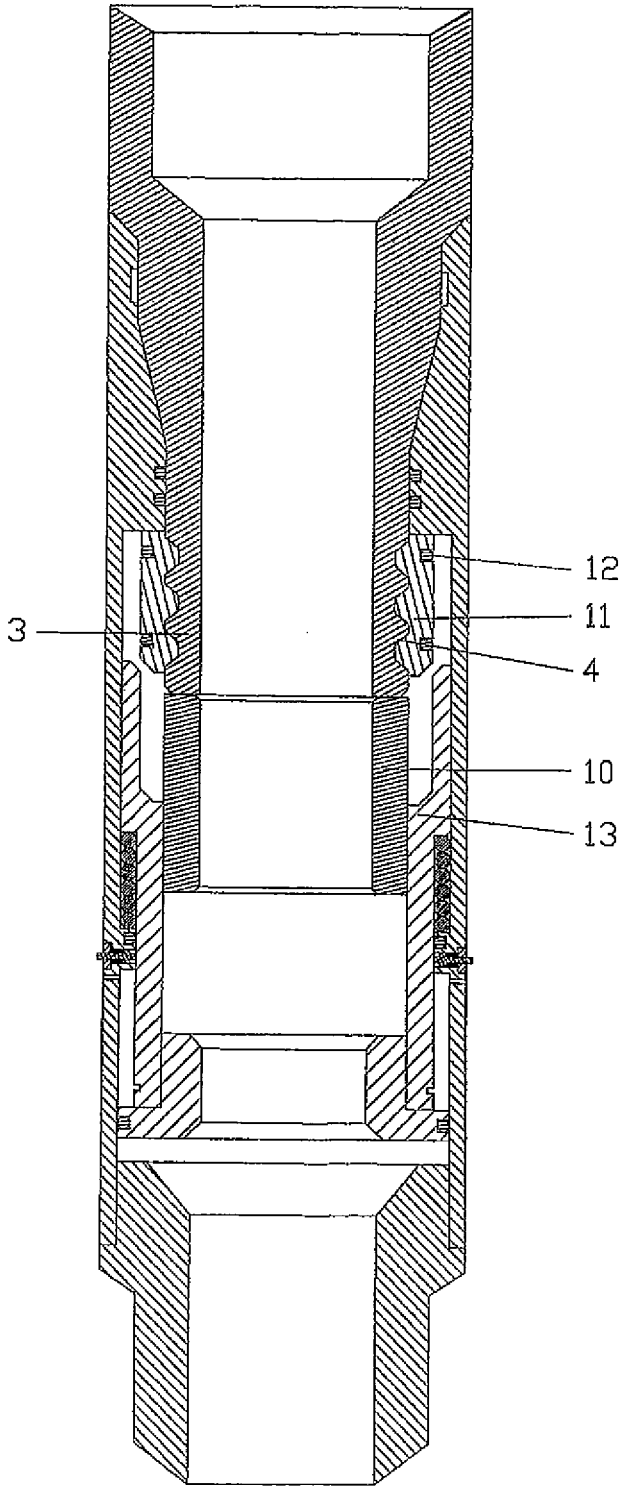
Figure 4:
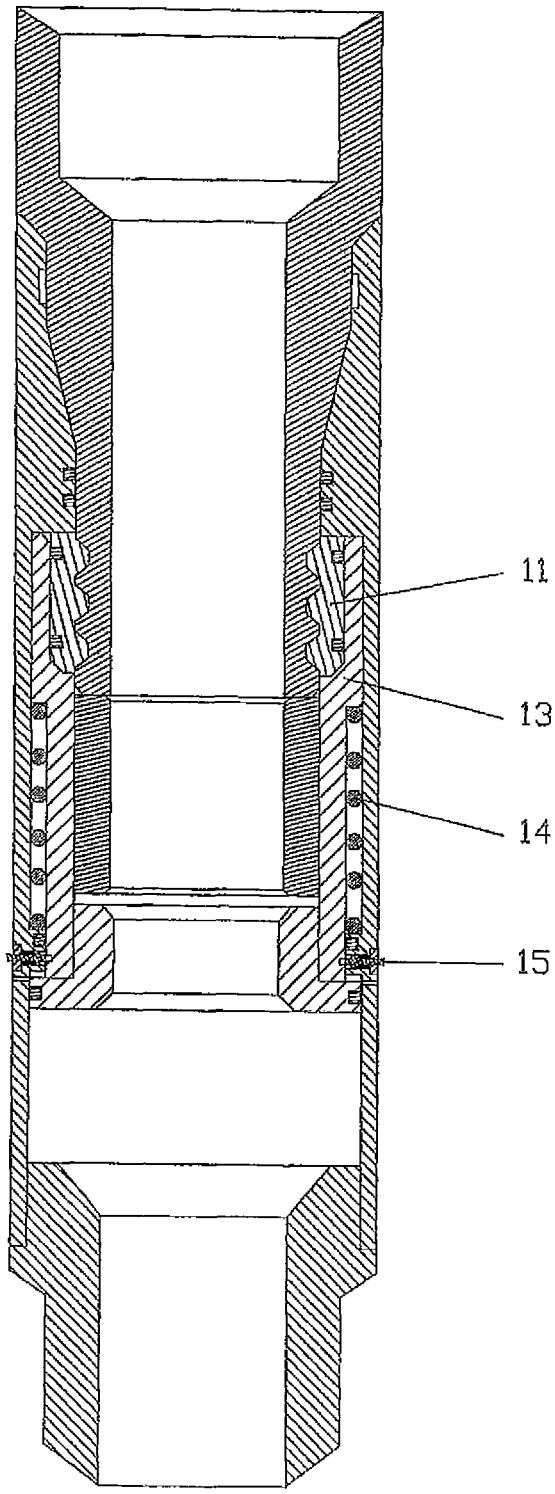
Figure 5:
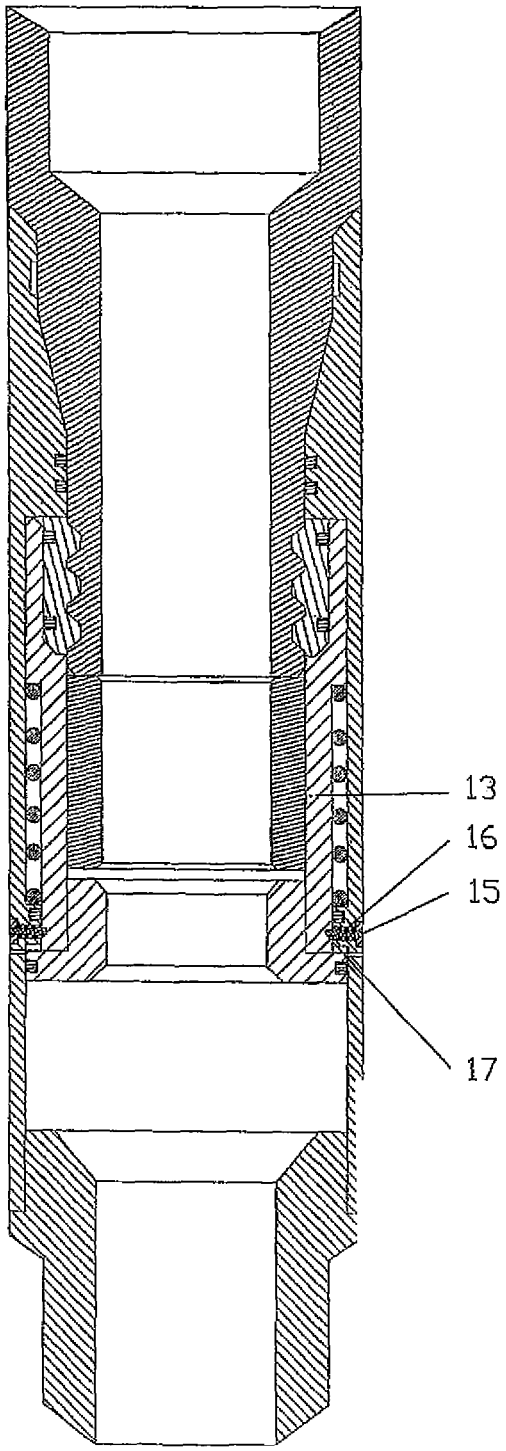
Figure 6:
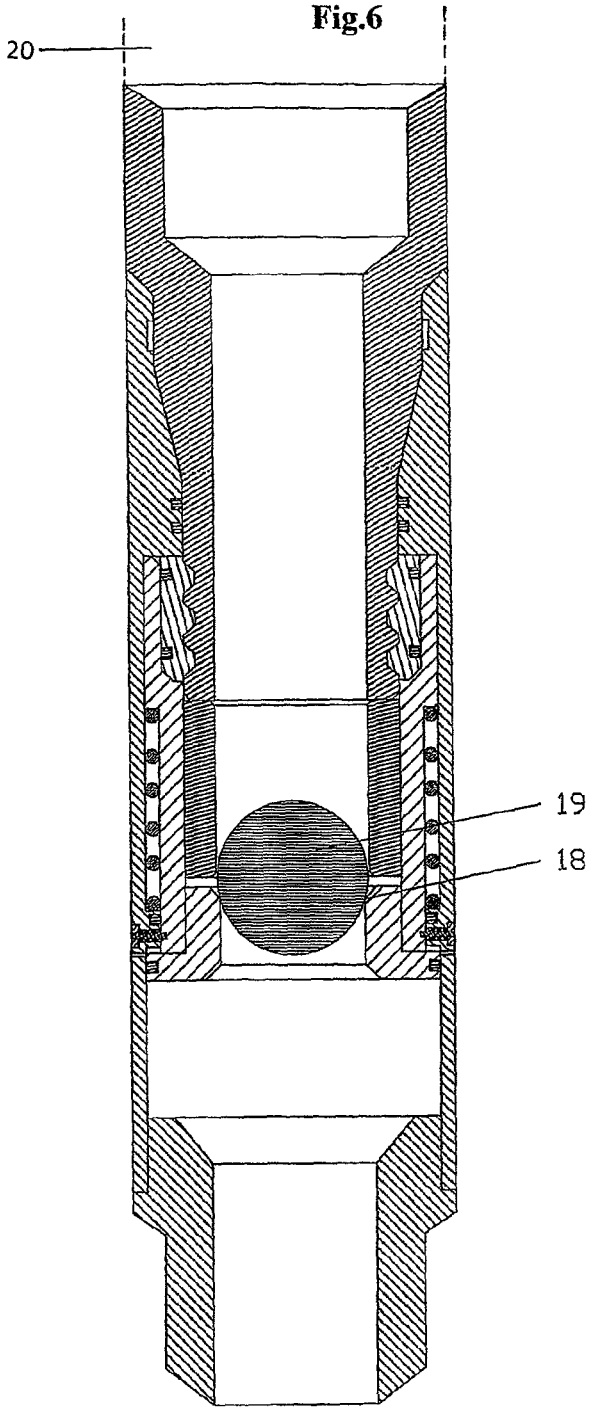
Figure 7:
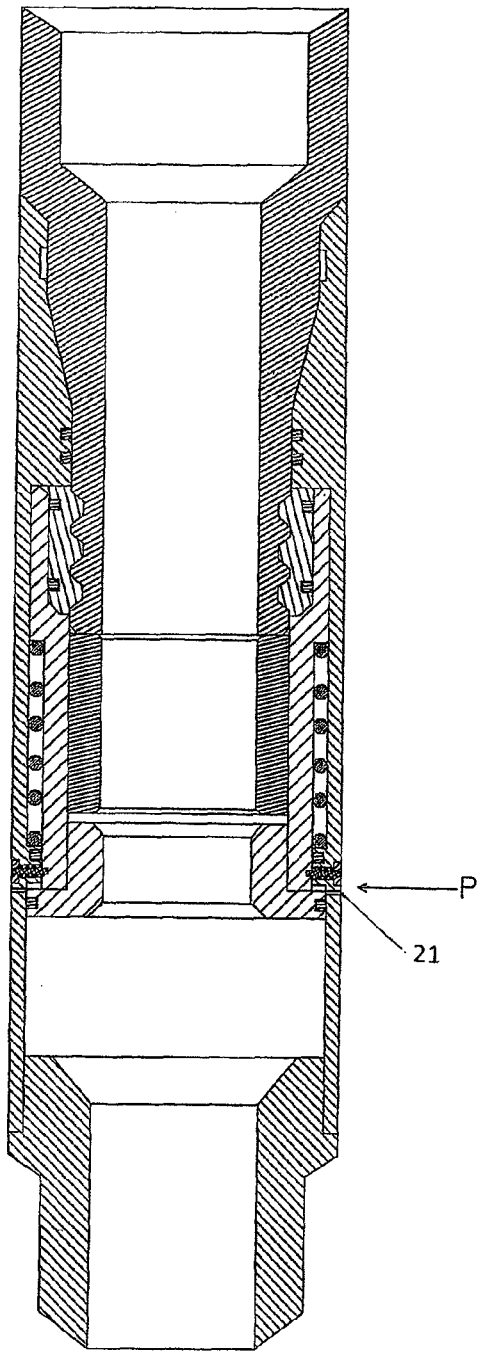

The present invention is illustrated with seven figures, of which:

FIG. 1 is a cross-section illustrating all parts of a coupling device according to the present invention, FIG. 2 illustrates a coupling device according to the invention, just before full mating of the male and female parts, FIG. 3 illustrates a coupling device according to the invention, just after mating the male and female parts, FIG. 4 illustrates a coupling device according to the invention, after the locking sleeve has been pushed up, FIG. 5 illustrates a coupling device according to the invention, after the verifying bolt has slided into place, with the coupling device ready for operation, FIG. 6 illustrates disconnecting the coupling device by use of a ball brought down the coiled tubing, and FIG. 7 illustrates an alternative method for disconnection.

DETAILED DESCRIPTION

Reference is first made to FIG. 1, illustrating a coupling device 1 according to the present invention, comprising a male part 2 with a conically shaped stinger part 3 with locking grooves 4, which male part is to be arranged at the end of a coiled tubing 20. Further, a female part 5 is illustrated, which in an upper end 6 has a receptacle 7 of conical shape adapted for receiving the stinger of the male part, and a house 8 that constitutes an outer part of the female part from the receptacle to a lower end 9. Inside the house of the female part there is an hold-open sleeve 10 arranged towards the upper end, but below the receptacle, which hold-open sleeve is axially displaceable within the house in the direction towards the lower end. Further, locking dogs 11 with spring pre-tensioning 12 are illustrated, which locking dogs are arranged between the house and hold-open sleeve, as the spring pre-tensioning pushes the locking dogs in towards the hold-open sleeve. Further, a locking sleeve 13 with spring pre-tensioning 14 is arranged below the locking dogs, with internal diameter towards the upper end large enough to be able to receive the hold-open sleeve and an outer diameter smaller than or equal to the outer diameter of the locking dogs as in extended position, and with spring pre-tensioning 14 which before mating of the male and female parts pushes the locking sleeve against the locking dogs. Further, two verifying bolts 15 with spring pre-tensioning 16, are illustrated, which verifying bolts before the mating of the male and female parts have an outer end extending out of the house. By mating the male and female parts the coupling device will lock automatically, as the hold-open sleeve 10 is pushed into the locking sleeve 13 by the stinger part, after which the locking dogs 11 are pushed into the grooves 4 of the stinger part, after which the locking sleeve is pushed up over the locking dogs and locking said locking dogs, after which the verifying bolts 15 at once the locking sleeve is in locking position will be pushed into dedicated openings 17 in the locking sleeve to thereby verify correct locking. The detail on FIG. 1 illustrates a verifying bolt in further detail, as a verifying bolt 15 and a spring for pre-tensioning 16 outside the bolt are illustrated in larger scale. The detail also illustrates how the spring 16 is restrained between an enlargement on the bolt and a locking device fastened with threads or in other way to the house.

The constructive design, including pre-tensioning with springs or other elastic elements, results in that the locking and verifying sequence is commenced automatically once the hold-open sleeve 10 is pushed down and into the locking sleeve 13. Thereby the locking is commenced automatically by joining the male and female parts, without any other manipulation than bringing the coupling parts together.

FIGS. 2 to 5 illustrate the locking sequence in further detail. On FIG. 2 the stinger part 3 of the male part is brought partly into the receptacle 7 of the female part, such that the stinger 3 abuts the hold-open sleeve 10. FIG. 3 illustrates the coupling device after the stinger 3 by bringing together the male and female parts has pushed the hold-open sleeve 10 down and into the locking sleeve 13 and the locking dogs 11 aided by the spring pre-tensioning 12 have been brought into effect with locking grooves 4 of the stinger, but before the locking sleeve 13 has been pushed up. FIG. 4 illustrates the mating after the locking sleeve 13 aided by spring pre-tensioning 14 has been pushed up over the locking dogs 11 thereby to lock the locking dogs, but before the verifying bolts 15 have been pushed into the locking sleeve. FIG. 5 illustrates the coupling device ready for operation, as the verifying bolts 15 have been pushed into the openings 17 in the locking sleeve 13, by the spring pre-tensioning 16, which verifies correct mating and locking.

FIG. 6 illustrates how the coupling device can be disconnected by bringing a ball 19 down the coiled tubing 20, as the ball 19 abuts a seat 18 in the locking sleeve, after which pressure applied on the ball through the coiled tubing results in the locking sleeve being pushed back to its lower position, so that the male part can be pulled out of the female part by axial tension. The ball 19 will remain down in the female part after disconnection, and is taken out together with the female part later. However, it can be preferable to modify the locking sleeve with a displaceable extension in towards the male part, where a seat for a ball is provided, such that the ball remains in the end of the male part and can be brought up to the surface.

FIG. 7 illustrates an alternative method for disconnection, by which a pressure P is applied through an opening 21 in the house at the verifying bolt, such that a piston chamber formed between the locking sleeve and house is pressurized, thereby to displace the locking sleeve to open position for the locking dog.

The biasing or pre-tensioning devices can be arranged differently than on the illustrations, for example by arranging springs in differently shaped grooves, or springs can be replaced by other types of elastic elements. Also the verifying bolts can be arranged differently, for example further up on the locking sleeve if the widest part of the wall of the locking sleeve is extended.

If disconnection takes place at the surface, the verifying bolts can be pulled out beforehand. At disconnection bottom-hole (inside a well-bore), the verifying bolts will be broken by shear, by the displacement of the locking sleeve, after which the male and female parts can be disconnected by axial tension.

The coupling device can be mated on the surface or bottom-hole. At mating bottom-hole, correct locking can be verified by a pulling test. However, at mating bottom-hole it can be preferable to modify the verifying bolt, by coupling said bolt to a position transmitter readable from the surface, thereby to be able to verify correct mating and locking from the surface also without a pulling test.

The invention claimed is:

1. A coupling device for connection and disconnection of bottomhole equipment, comprising:

a male part having a conically shaped stinger with locking grooves, the male part being configured to be attached to an end of a coiled tubing; and a female part adapted to be joined with the male part, the female part comprising a receptacle in an upper end thereof and a housing that constitutes an outer part of the female part extending from the receptacle to a lower end of the female part, the receptacle having a conical shape for receiving the stinger of the male part, wherein the female part further comprises:

a hold open sleeve physically separate from the male part, located within the housing, and axially displaceable in the housing from a position at the upper end of the female part, adjacent to and below the receptacle, toward the lower end of the female part, the hold open sleeve having an internal diameter smaller than a diameter of the receptacle;

locking dogs arranged between the housing and the hold open sleeve, with a first biasing device for pushing the locking dogs from an extended position radially inwards;

a locking sleeve located within the housing below the locking dogs and axially displaceable therein, with a second biasing device for pushing the locking sleeve axially upwards, the locking sleeve having an internal diameter toward the upper end large enough to receive the hold open sleeve and an outer diameter smaller than or equal to a diameter defined by the locking dogs in the extended position; and a verifying bolt provided on the housing, with a third biasing device for pushing the verifying bolt radially inwards from a position in which an outer end of the verifying bolt extends out of the housing, wherein the female part is further arranged such that upon joining the male and female parts, the hold open sleeve of the female part is pushed by the stinger of the male part into the locking sleeve, thereby causing the locking dogs to be pushed radially inwards into the grooves of the stinger, and the locking sleeve to be pushed up axially upwards to lock said locking dogs in the grooves, thereby automatically locking the coupling device, and causing the verifying bolt to be pushed so that an inner end of the bolt enters into an opening in the locking sleeve, thereby verifying correct locking, and wherein prior to the hold open sleeve being pushed by the stinger, the hold open sleeve is arranged within the housing of the female part.

2. The coupling device according to claim 1, further comprising several verifying bolts with spring pre-tensioning.

3. The coupling device according to claim 1, wherein the locking sleeve further comprises a seat for receiving a ball that can be brought down the coiled tubing, such that the coupling device can be open by applying pressure through the coiled tubing when the ball is placed sealingly in the seat.

4. The coupling device according to claim 1, wherein the locking grooves and locking dogs have axial surfaces of an angle below 90° towards the longitudinal axis of the coupling device, such that the male and female parts can be disconnected by axial tension when the locking sleeve is in a lower position.

5. The coupling device according to claim 1, wherein one or more of the first, second and third biasing devices takes the form of a spring.

6. The coupling device according to claim 1, wherein the female part further comprises a feed through opening in the housing, through which a fluid can be applied under pressure to open the coupling device.

7. The coupling device according to claim 1, wherein upon joining the male and female parts, the male and female parts are moved toward each other.

8. The coupling device according to claim 7, wherein the stinger of the male part is a separate component to the hold open sleeve of the female part.

9. The coupling device according to claim 1, wherein the stinger of the male part is a separate component to the hold open sleeve of the female part.

10. A coupling device for connecting coiled tubing to a wellbore tool, the device comprising:

a first, male part having a tubular male stinger provided with a locking groove; and a second, female part having a tubular housing adapted, at a receiving end of the housing, to receive the stinger therein for joining the two parts of the device; the female part comprising:

at least one locking dog biased radially inwards for engaging with the locking groove of the stinger upon connection of the male part and the female part;

a locking sleeve biased axially along the female housing toward the receiving end; and a hold open sleeve physically separate from the male part, located within the housing, and arranged to obstruct the locking dog from movement radially inwards whilst the locking dogs are arranged to obstruct movement of the locking sleeve axially toward the receiving end, in a hold open configuration, wherein the female part is configured such that upon receiving the stinger in the housing, the hold open sleeve is moved by the stinger from the hold open configuration, axially along the housing past the at least one locking dog and into the locking sleeve so as to release the locking dog, and thereby allow movement of the locking dog radially inwards to engage the locking grooves of the stinger and movement of the locking sleeve axially toward the receiving end into locking engagement with the locking dog for locking the male and female parts together, and wherein prior to being moved by the stinger, the hold open sleeve is in the hold open configuration.

* * * * *